US008089331B2

(12) United States Patent
Jacobson et al.

(10) Patent No.: US 8,089,331 B2
(45) Date of Patent: Jan. 3, 2012

(54) PLANAR MAGNETIC STRUCTURE

(75) Inventors: Boris S. Jacobson, Westford, MA (US); Mark P. Barnett, Framingham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/454,083

(22) Filed: May 12, 2009

(65) Prior Publication Data

US 2010/0289610 A1 Nov. 18, 2010

(51) Int. Cl.

| | |
|---|---|
| ***H01F 27/36*** | (2006.01) |
| ***H01F 5/00*** | (2006.01) |
| ***H01F 17/04*** | (2006.01) |
| ***H01F 27/28*** | (2006.01) |

(52) U.S. Cl. ..... 336/84 C; 336/200; 336/221; 336/222; 336/232

(58) Field of Classification Search ..... 336/83, 336/84 R, 84 M, 200, 232, 220–223
See application file for complete search history.

(56) References Cited

U.S. PATENT DOCUMENTS

| | | | | |
|---|---|---|---|---|
| 4,942,353 | A | 7/1990 | Herbert et al. | |
| 4,977,301 | A * | 12/1990 | Maehara et al. | 219/715 |
| 4,978,906 | A | 12/1990 | Herbert et al. | |
| 5,312,674 | A | 5/1994 | Haertling et al. | |
| 5,745,981 | A | 5/1998 | Roshen et al. | |
| 5,777,539 | A * | 7/1998 | Folker et al. | 336/200 |
| 5,959,522 | A * | 9/1999 | Andrews | 336/200 |
| 5,973,923 | A | 10/1999 | Jitaru | |
| 5,990,776 | A | 11/1999 | Jitaru | |
| 5,999,078 | A | 12/1999 | Herbert | |
| 6,445,272 | B1 * | 9/2002 | Mercado et al. | 336/225 |
| 6,628,531 | B2 | 9/2003 | Dadafshar | |
| 6,727,793 | B2 * | 4/2004 | Piechnick | 336/198 |
| 6,820,321 | B2 | 11/2004 | Harding | |
| 6,847,284 | B2 | 1/2005 | Gamou et al. | |
| 7,084,728 | B2 | 8/2006 | Hyvonen | |
| 7,187,263 | B2 | 3/2007 | Vinciarelli | |
| 7,248,138 | B2 * | 7/2007 | Chiang et al. | 336/200 |
| 7,262,680 | B2 * | 8/2007 | Wang | 336/200 |
| 7,304,862 | B2 | 12/2007 | Busletta et al. | |
| 7,361,847 | B2 | 4/2008 | Dunn et al. | |
| 7,382,219 | B1 * | 6/2008 | Lee | 336/84 C |
| 2002/0039062 | A1 * | 4/2002 | Kvarnsjo et al. | 336/221 |

(Continued)

FOREIGN PATENT DOCUMENTS

| | | |
|---|---|---|
| WO | WO 00/25141 | 5/2000 |

OTHER PUBLICATIONS

Kuffel et al., High Voltage Engineering, 1970, Pergamon Press, 337 pages England.

(Continued)

*Primary Examiner* — Anh Mai
*Assistant Examiner* — Mangtin Lian
(74) *Attorney, Agent, or Firm* — Iandiorio Teska & Coleman

(57) ABSTRACT

An improved planar magnetic structure in which the voltage gradient between core and windings is reduced by shields disposed between the one or more legs of the core and the windings and extending through the PWB layers; vias are offset to permit them to be contained within the path of the winding; and the induced magnetic and eddy currents intrinsic to interstitial shield layers are reduced by configuring the shield conductors with pairs of courses with opposite and offsetting current propagation.

25 Claims, 10 Drawing Sheets

U.S. PATENT DOCUMENTS

| | | | | |
|---|---|---|---|---|
| 2003/0095026 | A1* | 5/2003 | Kawanobe | 336/200 |
| 2004/0032313 | A1* | 2/2004 | Ferencz et al. | 336/200 |
| 2004/0240126 | A1 | 12/2004 | Tiemeijer | |
| 2006/0232301 | A1 | 10/2006 | Morlion et al. | |
| 2006/0267718 | A1 | 11/2006 | Salama et al. | |
| 2007/0018334 | A1 | 1/2007 | Peytavy et al. | |
| 2007/0217168 | A1 | 9/2007 | Masuyama et al. | |
| 2008/0007249 | A1 | 1/2008 | Wilkerson et al. | |
| 2008/0094166 | A1* | 4/2008 | Hsu et al. | 336/223 |
| 2009/0115564 | A1* | 5/2009 | Minteer | 336/84 M |
| 2009/0189725 | A1* | 7/2009 | Ding et al. | 336/137 |

OTHER PUBLICATIONS

Carsten, Bruce, Design Consideration for High Frequency Magnetics, HFPC, Apr. 1994, Proceedings, pp. 459-501.

Wang, Shen, Modeling and Design of Planar Integrated Magnetic Components, Virginia Polytechnic Institute and State University, Jul. 21, 2009 pp. 1-87.

Loi, Gian Luca et al. A Thermally-Aware Performance Analysis of Vertically Integrated (3-D) Processor-Memory Hierarchy, DAC 2006, Jul. 24-28, 2006.

Bloom, Ed, Planar Power Magnetics, Magnetics Business and Technology, Aug. 2002.

Parker, B., et al. Serpentine Coil Topology for BNL Direct Wind Superconducting Magnets, IEEE, 2005 pp. 737-739.

Wang, Shen, et al., Reduction of High-Frequency Conduction Losses Using a Planar Litz Structure, 2003 IEEE 34$^{th}$ Annual vol. 2, Issue, Jun. 15-19, 2003, pp. 887-891.

* cited by examiner

PLANAR MAGNETIC STRUCTURE

FIELD OF THE INVENTION

This invention relates to an improved planar structure with reduced voltage gradient between windings and core, compact placement of vias within the winding path, and improved shields to reduce induced magnetic fields.

BACKGROUND OF THE INVENTION

Using planar magnetics allows the reduction in height of magnetic components and increase in power density for state-of-the-art DC/DC converters. However, conventional structures suffer from excessive copper losses and rely on the increased spacing between windings and the core to prevent corona inception and insulation breakdown. This conventional approach has several problems.

Corona discharge and eventual insulation breakdown can be caused by voltage concentration across the air gap between the magnetic core and the printed wiring board (PWB). Insulation that supports AC voltages includes air (the gap between the core and the edge of the board) and solid material inside the PWB. When voltage is applied across two dissimilar materials such as air and a solid dielectric, material with the lower permittivity (air) will receive higher stress. The fact that voltage breakdown of air is sensitive to changes in humidity and altitude farther complicates this problem. In addition, all air gaps in the planar assembly can fluctuate due to assembly tolerances.

Interconnect vias increase component area. Individual winding turns and sections located on different layers are connected by PWB vias placed outside the immediate winding path. This arrangement requires additional area and increases winding resistance.

Added capacitance and increased winding losses can be caused by electrostatic shields. The shields reduce coupling between transformer windings thereby reducing common-mode noise currents. However, they increase transformer capacitance and eddy current losses.

SUMMARY OF THE INVENTION

This invention features a planar magnetic structure including a printed wiring board having at least one winding segment, an inner clearance through the printed wiring board within the winding segment, and at least one outer clearance through the printed wiring board external to the winding segment. There is a core having an inner leg extending through the inner clearance and at least one outer leg extending through the outer clearance defining a gap occupied by the winding segment. An inner shield is disposed between the inner clearance and the inner core leg. The inner shield surrounds the inner leg but is less than one turn defining a shield gap. The shields reduce the voltage gradient between the core legs and the winding segment. There is at least one outer electrostatic shield between the outer clearance and the at least one core outer leg, the outer shield is disposed between the outer leg and inner leg and a guard barrier proximate the shield gap and between the shield gap and the winding segments reduces the voltage gradient between the inner shield end at the gap and the winding segment.

In preferred embodiments there may be at least two outer clearances, two outer core legs and two outer shields. The printed wiring board may have a number of winding segments in a stacked array and the clearances, core legs and shields may extend through the printed wiring board coextensive with all of the number of winding segments. The shields and the core legs, and the guard barrier may be at the same, fixed voltage potential. The fixed potential may be ground. The winding segments may form the windings of a transformer.

This invention also features a planar magnetic structure including a printed wiring board having a plurality of layers, a core having a central leg and at least one external leg spaced from the central leg and extending through the layers of the printed wiring board and a winding segment on each layer, each winding segment having a generally spiral path about the central leg between the central leg and the one or more external legs. The winding segments are connected together from layer to layer. There are a plurality of vias extending through the layers within the boundaries of the generally spiral path. Each of the winding segments except the last winding segment has its output connected to the input of the next winding segment through a via which is within the boundaries of the generally spiral path and the vias unconnected at any particular winding segment passing through that winding segment without electrical contact.

In preferred embodiments the spiral path may be curvilinear. The spiral path may be rectilinear. All of the winding segments may be wound in the same direction. All of the winding segments may be wound in the same direction alternately inwardly and outwardly. All of the winding segments may be wound in the same direction alternately outwardly and inwardly. The winding segments may be connected in series. The vias may be offset with respect to one another within the boundaries of the generally spiral path. The vias may be offset longitudinally along the direction of the generally spiral path. The vias may be offset laterally in the generally spiral path. The winding segments may have a whole number of turns. The windings segments may have a fractional number of turns.

This invention also features an electrostatic shield for a multilayer electronic device including at least one interstitial shield layer and a shield on the shield layer including a serpentine conductor made of a series of courses, each pair of courses in the serpentine conductor propagating current in opposite directions for offsetting the induced magnetic fields and resulting currents.

In preferred embodiments the serpentine conductor may be arranged in a circumferential path of less than one turn. The courses may extend radially.

This invention also features an electrostatic shield for a multilayer electronic device including a first set of conductors including at least two spaced courses and a second set of conductors including at least two spaced courses interdigitated with the first set of conductors; each of the conductors including a barrier section which separates the courses of the other set of conductors and is connected to a fixed potential.

In preferred embodiments the courses may be curvilinear. The courses may be rectilinear. The courses may be less than one turn. The device may include a magnetic structure having a core and the courses may surround the core.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
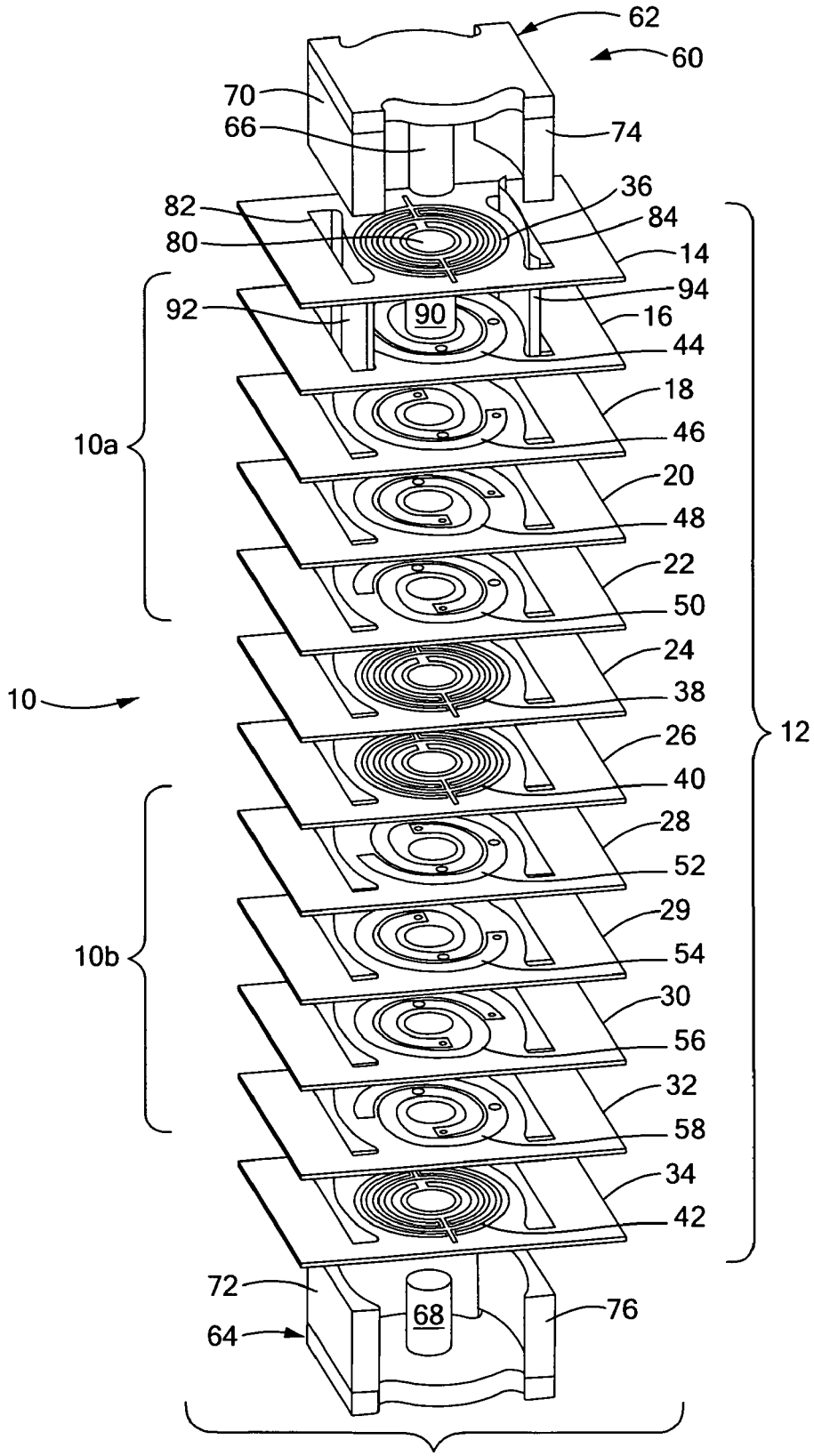
FIG. 1 is an exploded three dimensional view of a full stacking of primary, secondary and shield layers of a planar transformer constructed according to the teachings of the present invention in which connecting vias are not shown for ease of illustration.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

There is shown in FIG. 1 an embodiment of this invention in a transformer 10 having a primary winding 10*a* and secondary winding 10*b* constructed on a multi-layer circuit board 12 formed of a stacked array of twelve layers 14, 16, 18, 20, 22, 24, 26, 28, 30, 32, 34. Layers 14-24 are associated with primary winding 10*a* while layers 26-34 are associated with secondary winding 10*b*. Layers 14, 24, 26, and 34 are shield layers and contain on them shields 36, 38, 40, and 42, respectively. Layers 16-22 are winding layers and contain winding segments 44, 46, 48, and 50, which combine to form the primary winding 10*a*, layers 28-32 are winding layers containing winding segments 52, 54, 56 and 58 which are associated with secondary winding 10*b*. Shield layers 14, 24, 26, and 34 and their associated shields 36, 38, 40, and 42 conventionally reduce coupling between transformer windings thereby reducing common mode noise currents. However, these shields in accordance with this invention additionally decrease transformer capacitance and eddy current losses intrinsic to conventional shields and are discussed more fully in FIGS. 8-10. Each transformer core 60 includes an upper section 62 and lower section 64. Core 60 includes an inner leg such as formed by center leg sections 66 and 68 and at least one external leg such as formed by external leg sections 70, 72. There may be a number of external leg sections in addition such as formed by external leg sections 74 and 76. Each layer, 14-34 includes an inner clearance hole 80 and outer clearance holes 82 and 84 which have been numbered only on layer 14 for the sake of clarity. Inner clearance holes 80 accommodate the center leg formed by center leg sections 66 and 68 while the external clearances 82 and 84 accommodate the external legs formed by external leg sections 70, 72, and 74, 76, respectively. To reduce the voltage gradient and therefore the probability of voltage breakdown or corona discharge between the inner leg sections 66, 68 and the winding segments 44-50 and 52-58 on layers 14-22 and 28-32, respectively, a shield 90 is plated on the inside of clearances 80 and shields 92 and 94 are plated on the inner walls of clearances 82 and 84. Shield 80 reduces the voltage gradient between center leg section 66, 68 and winding segments 44-50 and 52-58, while shields 92 and 94 reduce the voltage gradient between windings 44-50 and 52-58 and the external core leg sections 70, 72 and 74, 76, respectively.

Figure 2:
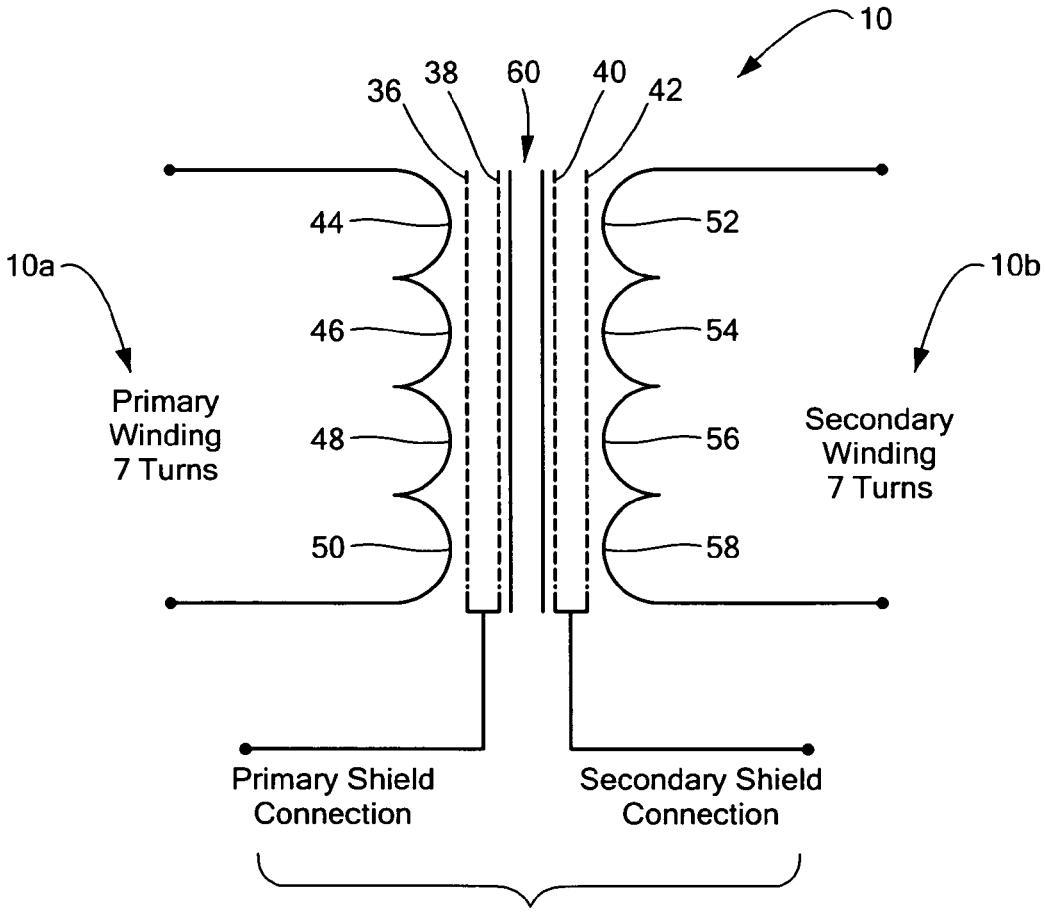
FIG. 2 is a circuit diagram of the transformer of FIG. 1.
Figure 3:
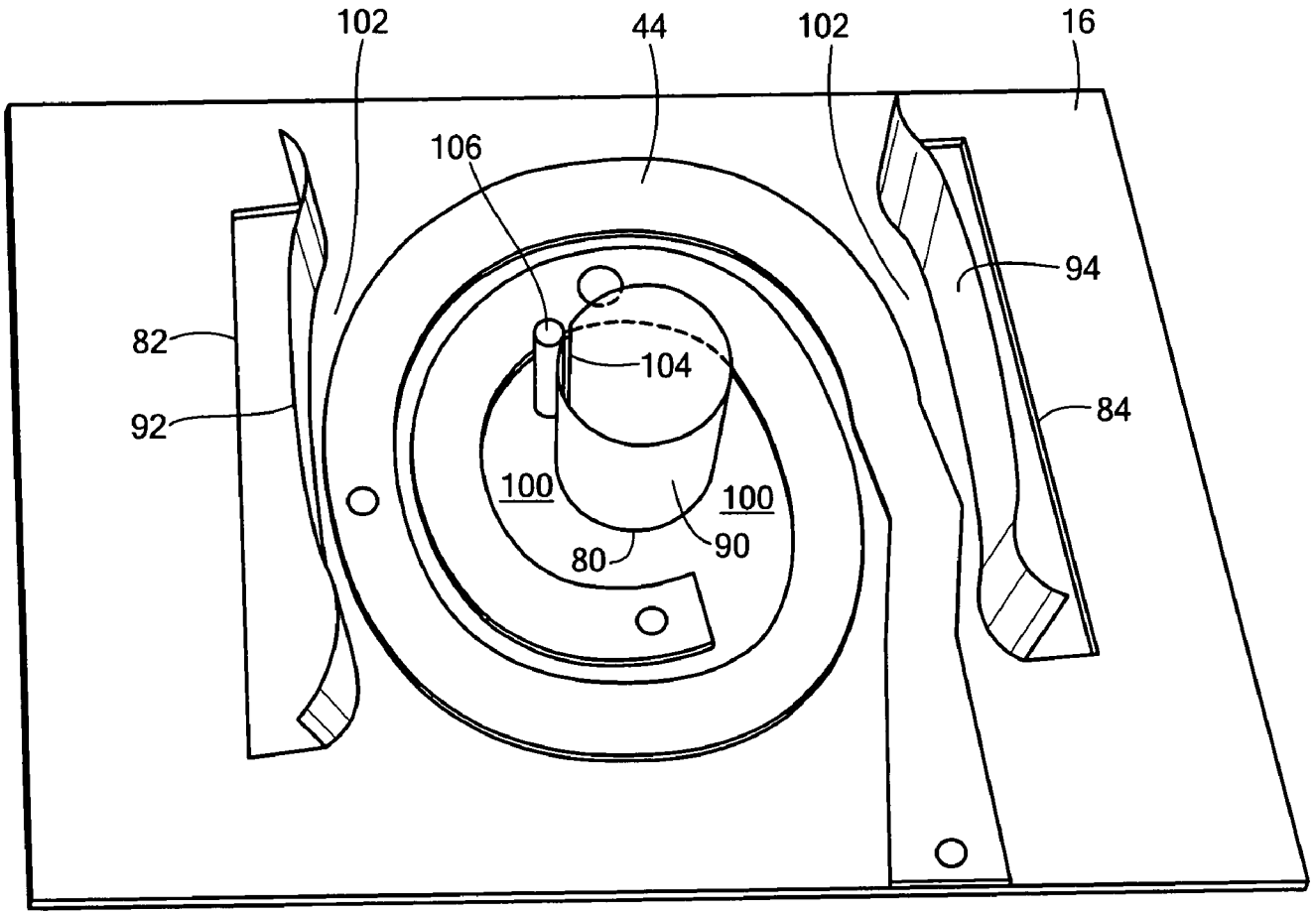
FIG. 3 is a three dimensional rear view showing in greater detail, a single layer of the transformer of FIG. 1 illustrating the layer winding path, leg and center clearance hole edge plating and the construction of unconnected and global ground barrier vias according-to the teachings of the present invention.
Figure 4:
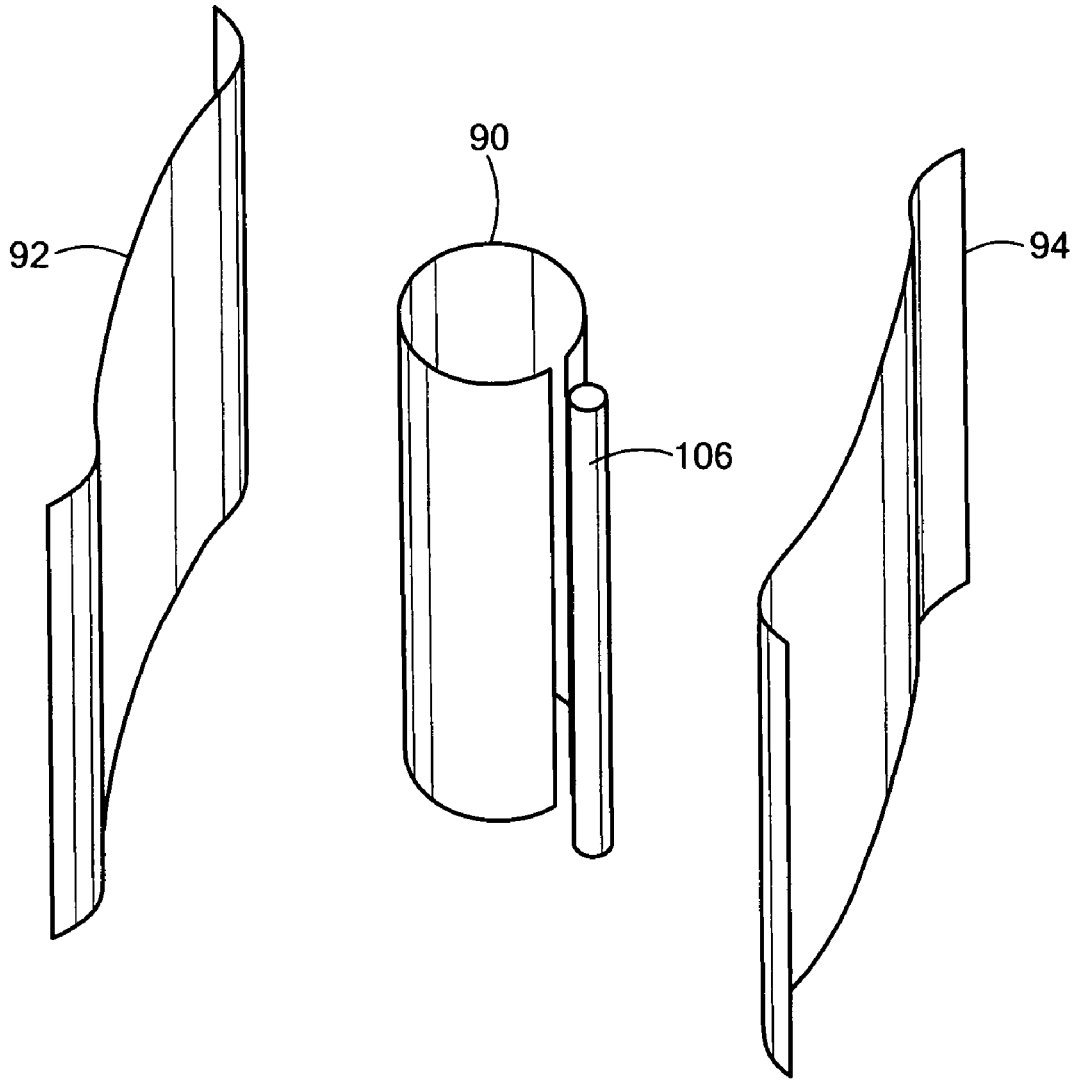
FIG. 4 illustrates in greater detail, the edge plating for the center, left and right ferrite core clearance holes of FIG. 1 according to the teachings of the present invention.

An electrical schematic circuit of transformer 10 is shown in FIG. 2 where the fundamental electrical nature of transformer 10 can be more easily seen. Note that the four winding segments 44, 46, 48 and 50 which constitute primary winding 10*a* result in seven turns, as too with the four secondary winding segments 52, 54, 56 and 58. This is so because each winding segment 44-58 constitutes 1.75 turns. The configuration of outer shields 92, 94 and inner shield 90 which reduces the voltage gradient between winding segment 44 and the core legs which normally are present in clearances 80, 82, and 84 that are omitted for clarity is shown to better advantage in FIG. 3. Shield 90 for example, plated about clearance 80 reduces the voltage gradient between the inner edge of winding segment 44 and the inner core leg normally present in clearance 80 in the gap indicated at 100. Shields 92 and 94 likewise reduce the voltage gradient between the outer edges of winding segment 44 and the outer core legs normally present in clearances 82 and 84 at gaps 102. In accordance with this invention inner shield 90 surrounds the inner core leg but stops short of completely surrounding it in order to avoid presenting a completed, shorted turn. For this reason shield 90 contains a gap 104. In creating this gap 104, however, to prevent a shorted turn, a secondary area near the edges of the gap where a voltage gradient is high is now created. Note that winding segment 44 typically contains a high voltage for example 1,000 or 1,500 volts as opposed to the core. To reduce steep voltage gradients and to prevent a breakdown a guard barrier 106 is provided near gap 104, between it and the inner edge of winding segment 44. Thus, the voltage will be applied between the inner edge of winding segment 44 and guard barrier 106 while the voltage between guard barrier 106 and gap 104 will be minimal. Because the guard barrier radius is greater that that of the edge of the gap 90 the steep voltage gradient between the inner edge of winding segment 44 and the gap 90 will be reduced. Guard barrier 106 is typically a via as shown more clearly in FIG. 4 where all parts have been removed with the exception of shields 90, 92, 94 and guard barrier 106.

Figure 5:
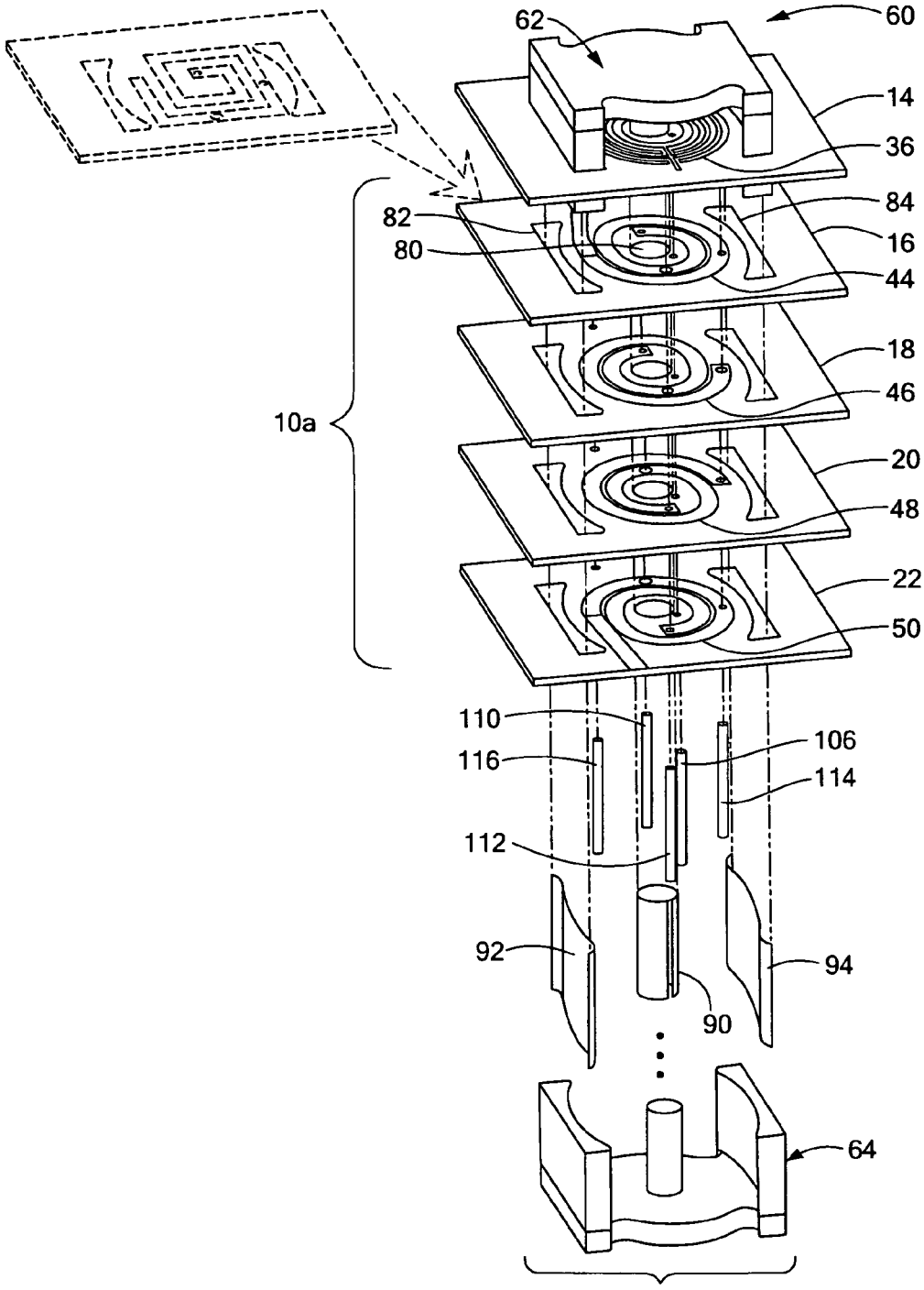
FIG. 5 is an exploded three dimensional front view of the upper shield layer and top four layers of the primary winding of the transformer of FIG. 1 illustrating interconnecting and global ground vias constructed according to the teachings of the present invention.

In another aspect of the invention, FIG. 5, the winding segments and their associated via which interconnect them are kept compact employing a minimum amount of area on the printed wiring board layers. In conventional structures the vias are often grouped in the area of the wiring board between the winding segment conductor turns see U.S. Pat. No. 6,847, 284, FIG. 51. However, in this invention the vias are always confined within the boundaries of the path of the winding segment. In this case the winding segment has a generally spiral path which is curvilinear. It may as well be rectilinear or any other shape and it need not necessarily be spiral. In the embodiment of this invention as shown in FIG. 5, the guard barrier via 106 does not interconnect with any winding segment. The other three vias 110, 112, and 114 do. The remaining via in FIG. 5 is a global ground via 116, for example, and there may be more than one of these. There will typically be a number of local vias 110, 112, 114, which is one less than the number of winding segment layers. In this case since there are four winding segment layers there are three local vias, 110, 112, 114.

Figure 6:
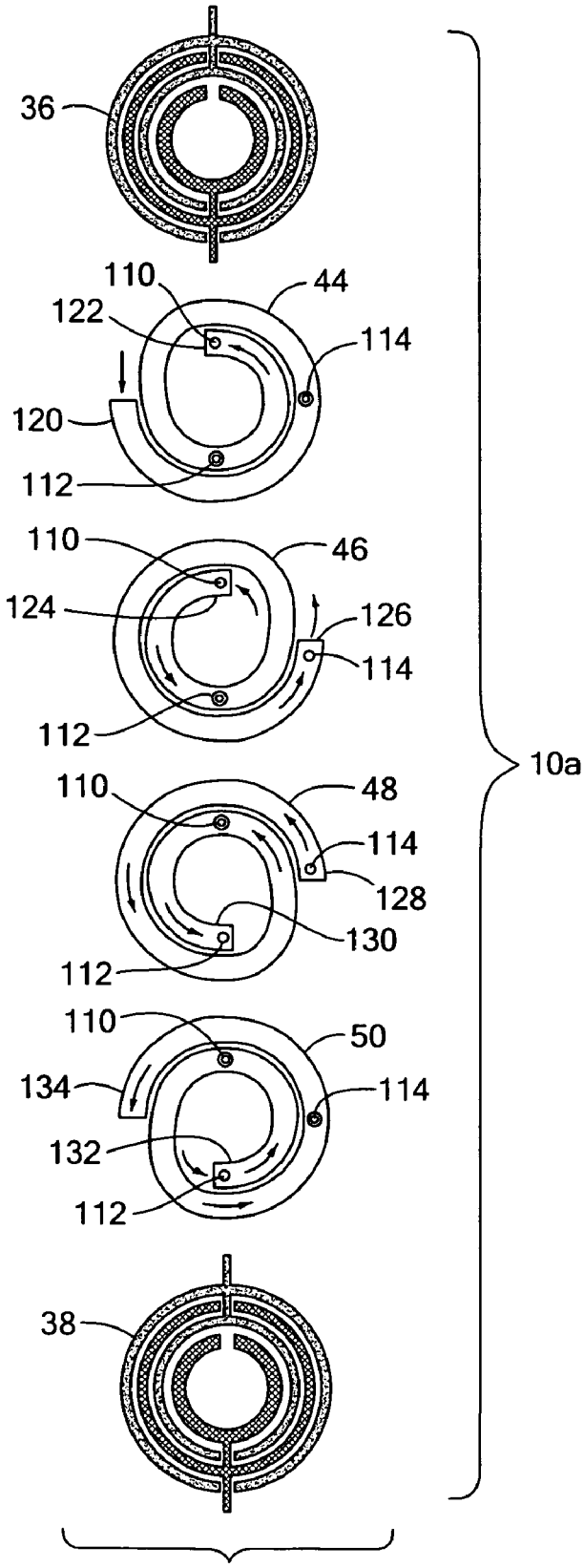
FIG. 6 is a two dimensional top view of the primary winding and shield layers of the transformer of FIG. 1 showing the winding path details, vias and clearance hole of each such layer constructed according to the teachings of the present invention.

The continuity of the winding segments 44-50 and their interconnection using vias 110, 112 and 114 are shown to better advantage in FIG. 6. There each winding segment 44-50 is shown having a generally spiral path about the center leg of the core and confined between the central leg and the one or more external legs which are not shown in FIG. 6. The winding segments are connected together from layer to layer using the vias; there are a plurality of vias 110, 112, 114. These vias are confined within the boundaries of the generally spiral path of the winding segments. Each winding segment except the last winding segment has its output connected to the input of the next winding segment through a via which is again within the boundaries of the generally spiral path. The vias unconnected at any particular winding segment pass through that winding segment without electrical contact. Although the spiral paths of the winding segments in FIG. 6 are shown as curvilinear they may be rectilinear or may take other shapes.

All of the winding in FIG. 6 are wound in the same direction but alternately inwardly and outwardly (or they could be wound outwardly and inwardly). The winding segments are connected in series through the vias which are offset with respect to one another within the boundaries of the generally spiral path of the winding segments. The vias may be offset within the spiral path either longitudinally along the spiral path or laterally to the general path. Each winding segment may have an integer or whole number of turns or may be fractional turns. Thus far in this embodiment each winding segment has a length of 1¾ turns but of course this is not limiting to the invention.

In FIG. 6 the vias shown by a single circle in a winding segment indicate vias which are electrically connected to that winding segment while vias indicated by a double circle indicate vias which are not electrically connected to that winding segment. Current is introduced into winding segment 44 at input end 120 and propagates through it in a counterclockwise direction, as indicated by the arrows, passing via 114, which is not electrically connected, and via 112 which is not electrically connected, until it reaches the output end and via 110 which is electrically connected. From via 110 the current moves down to the input 124 of winding segment 46 where it again moves counterclockwise past via 112, to which there is no electrical connection, and then to via 114 which is electrically connected to output end 126. From output end 126 the current moves down via 114 to the input end 128 of winding segment 48 where again it moves in a counterclockwise direction past via 110, to which it is not electrically connected, until it reaches the output 130 and then passes through via 112 which is electrically connected. Via 112 is connected to the input 132 of winding segment 50, the current then continues to move past via 110 and 114, neither of which is electrically connected, to the output end 134.

Figure 7:
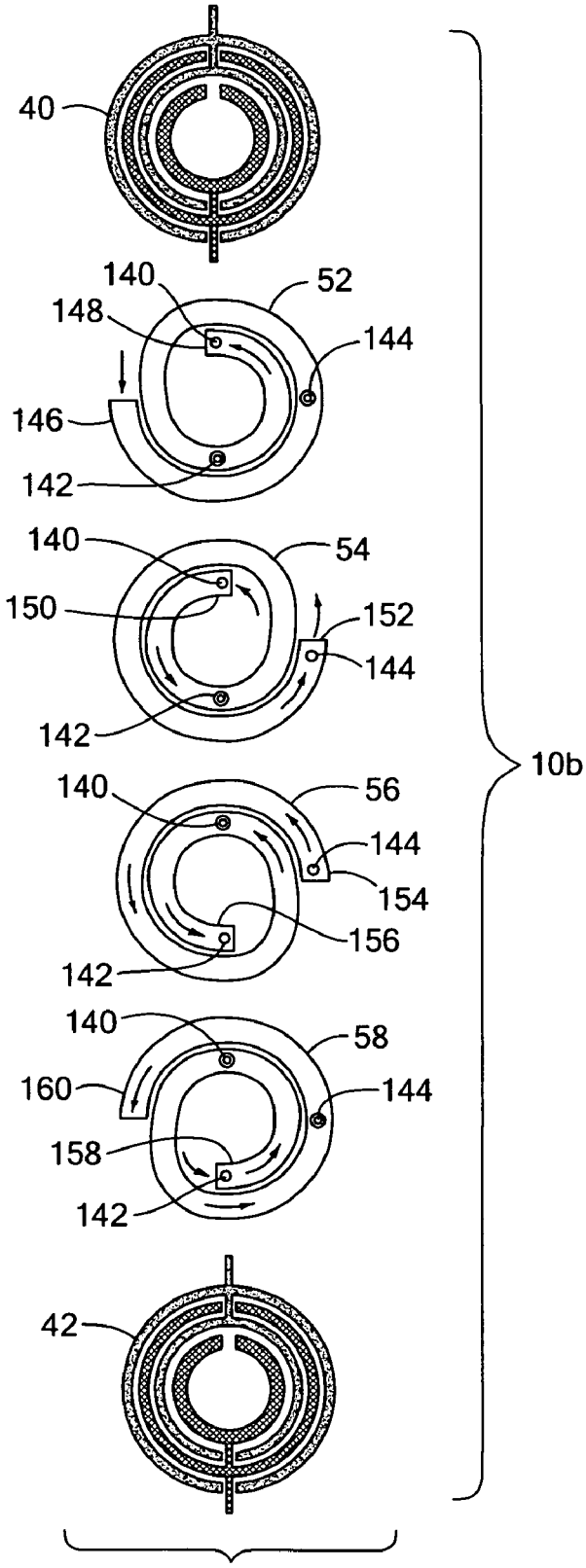
FIG. 7 is a two dimensional top view of the secondary winding and shield layers of the transformer of FIG. 1 showing the winding path details, vias and clearance holes of each such layer constructed according to the teachings of the present invention.

Similarly, with respect to secondary winding 10*b*, FIG. 7, winding segments 52, 54, 56 and 58 are interconnected by a second set of vias 140, 142, 144. Current introduced at the input end 146 of winding segment 52 moves counterclockwise past vias 144 and 146, with no electrical contact, to the output end 148 where there is contact with via 140. The current moves down via 140 to the input end 150 of winding segment 54. It then moves past via 142, without electrical contact, and then makes contact with via 144 at output 152. Via 144 makes contact with input 154 of winding segment 56 and the current moves past via 140, without electrical contact, and makes electrical contact at output end 156 with via 142. The current moves into input end 158 of winding segment 58 and moves past vias 140 and 144, without electrical connection, to reach the output end 160.

Figure 8:
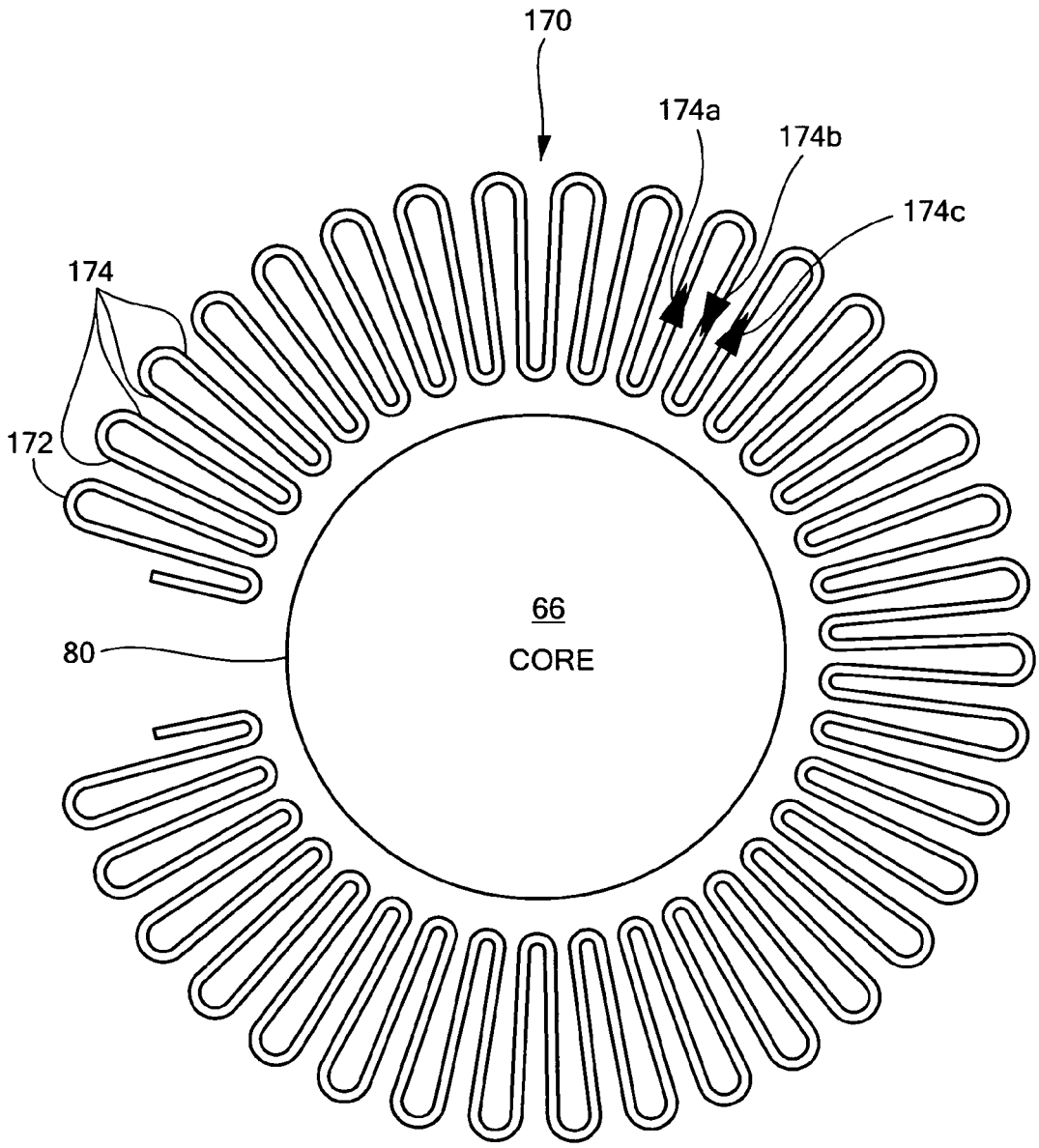
FIG. 8 illustrates a serpentine conductor pattern for the shield layers of the transformer of FIG. 1 constructed according to the teachings of the present invention.
Figure 9:
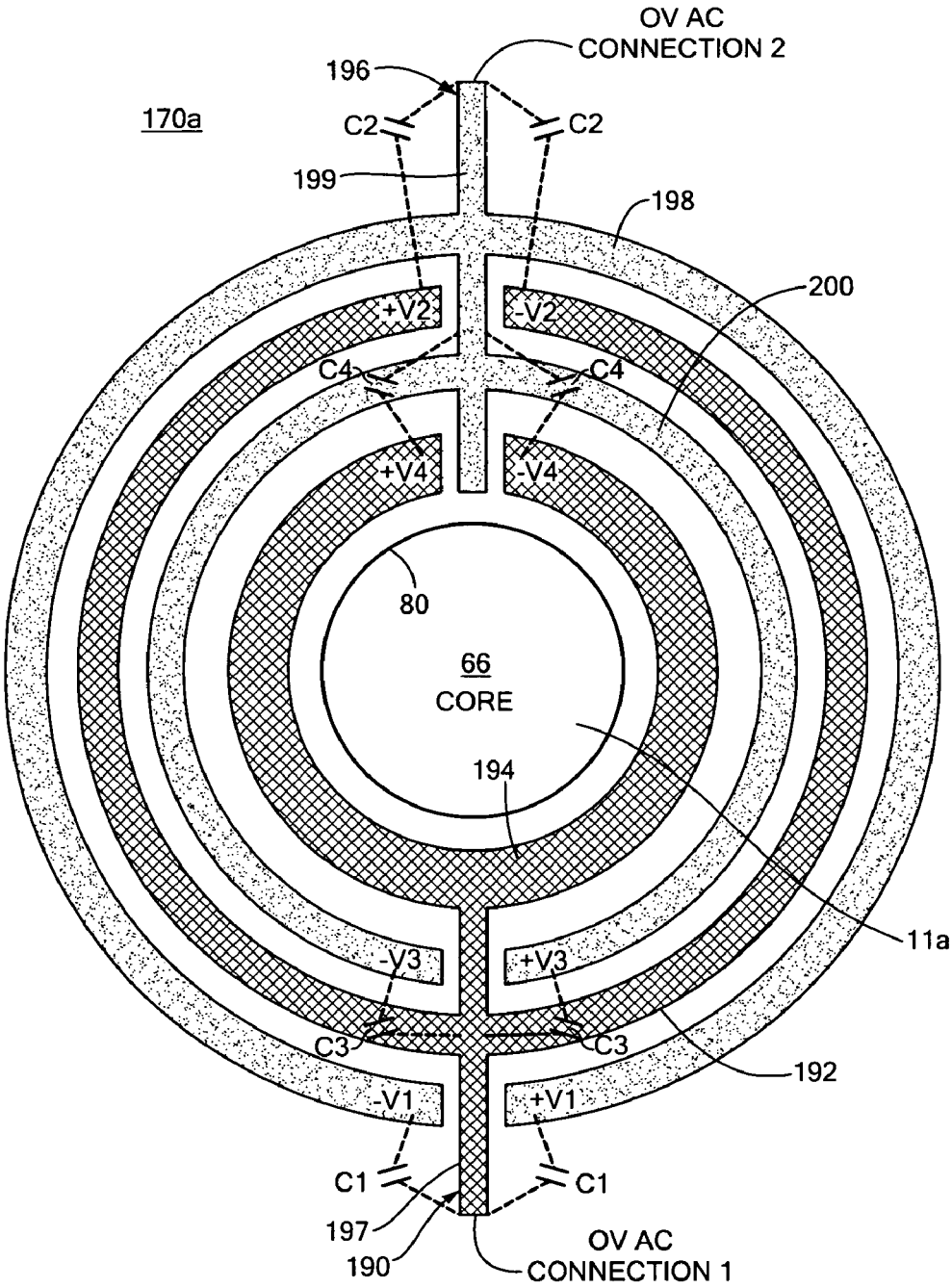
FIG. 9 illustrates an interdigitated conductor pattern included in the shield layers of the transformer of FIG. 1 constructed according to the teachings of the present invention.
Figure 10:
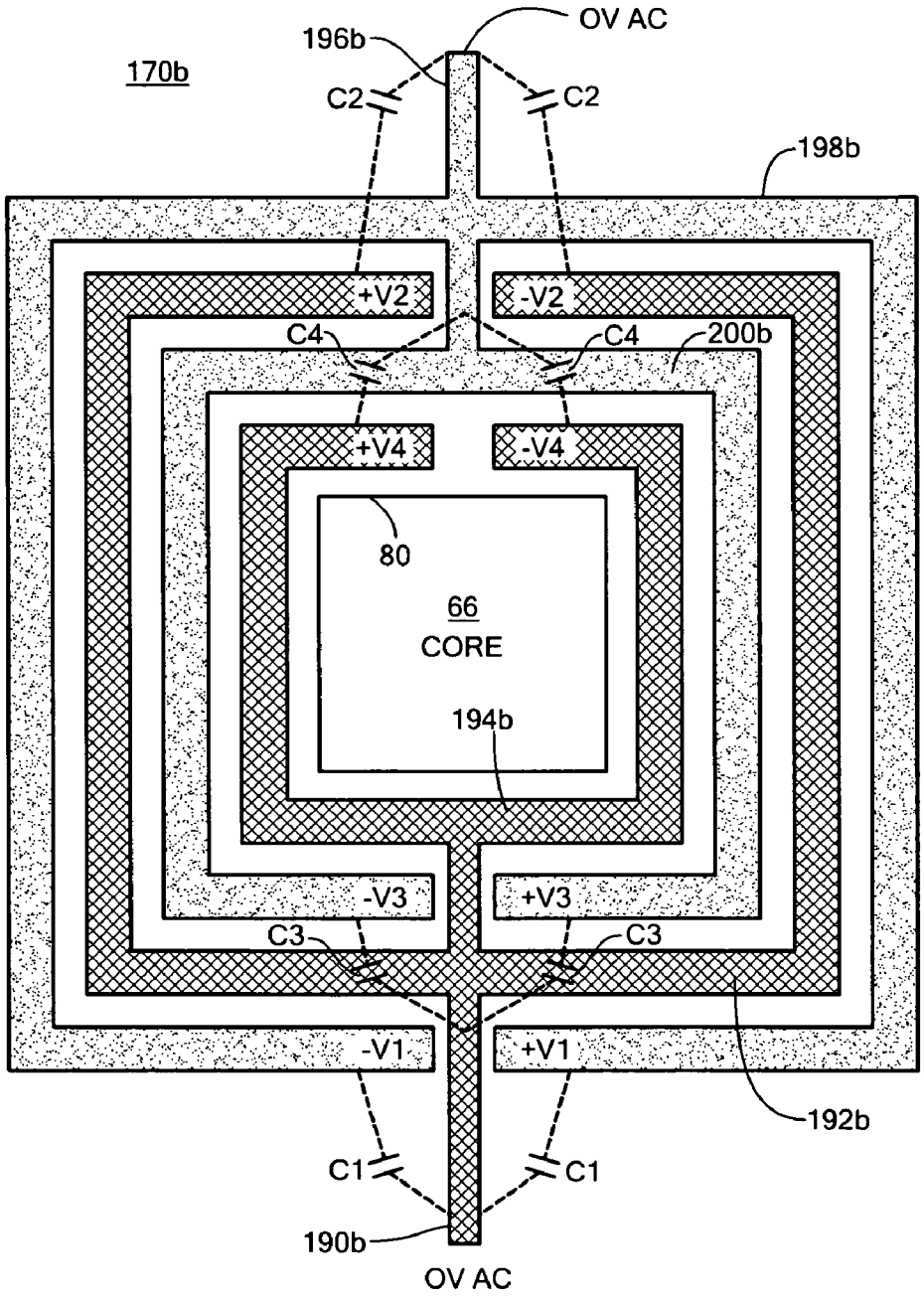
FIG. 10 illustrates an alternative interdigitated conductor pattern for use in the shield layers of the transformer of FIG. 1 constructed according to the teachings of the present invention.

In another aspect of the invention interstitial shields 36, 38, 40, 42 may be formed on a shield layer with a serpentine conductor made of a series of courses each pair of courses in the serpentine conductor propagating current in opposite directions for offsetting the induced magnetic fields and resulting currents. The serpentine conductor may be arranged in a circumferential path of less than one turn. The courses may extend radially. Such a device is shown in FIG. 8, where shield 170 is formed from a serpentine conductor 172 formed from a plurality of courses 174 which run alternately in opposite directions. In this case they extend radially and the current in one course, for example, course 174*a* may run radially outward and in the next one 174*b* radially inward. In the next course 174*c* the current will run radially outward and so on. In this way the oppositely directed currents produce offsetting magnetic fields and resulting currents. The shield may take other forms such as indicated by shield 170*a*, FIG. 9, which is an interdigitized shield which has two sets of conductors including at least two spaced courses. The first set of conductors 190 includes two spaced courses 192 and 194. The second set of conductors 196 includes a first course 198 and second course 200. Each of the courses 192, 194, 198, and 200 stop short of forming a complete turn, to prevent a shorted turn. Each set of conductors 190, 196 includes a barrier section 197, 199 which separates the courses of the other set of conductors and is connected to a fixed potential. Although the shield in FIG. 9 is shown as a curvilinear arrangement of courses this is not a necessary limitation of the invention for as shown in FIG. 10, the courses may be arranged in a rectilinear fashion as well, for example.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A planar magnetic structure comprising a printed wiring board having at least one winding segment;

an inner clearance through said printed wiring board within said winding segment;

at least one outer clearance through said printed wiring board external to said winding segment;

a core having an inner leg extending through said inner clearance and at least one outer leg extending through said outer clearance defining a gap occupied by said winding segment;

an inner shield between said inner clearance and said inner core leg, said inner shield surrounding said inner leg but being less than one turn defining a shield gap; said shields reducing the voltage gradient between said core legs and said winding segment; and at least one outer electrostatic shield between said outer clearance and said at least one core outer leg, said outer shield disposed between said outer leg and inner leg; and a guard barrier proximate said shield gap and between said shield gap and said winding segments; said guard barrier reducing the voltage gradient between said inner shield end at said gap and said winding segment.

2. The planar magnetic structure of claim 1 in which there are at least two outer clearances, two outer core legs and two outer shields.

3. The planar magnetic structure of claim 1 in which said printed wiring board has a number of winding segments in a stacked array and said clearances, core legs and shields extend through said printed wiring board coextensive with all of said number of winding segments.

4. The planar magnetic structure of claim 1 in which said shields and the core legs, and said guard barrier are at the same, fixed voltage potential.

5. The planar magnetic structure of claim 4 in which said fixed potential is ground.

6. The planar magnetic structure of claim 1 in which said winding segments form the windings of a transformer.

7. A planar magnetic structure comprising:

a printed wiring board having a plurality of layers;

a core having a central leg and at least one external leg spaced from said central leg and extending through said layers of said printed wiring board;

a winding segment on each layer, each winding segment having a generally spiral path about said central leg between said central leg and said one or more external legs; said winding segments being connected together from layer to layer;

a plurality of vias extending through said layers within the boundaries of said generally spiral path;

each of said winding segments except the last winding segment having its output connected to the input of the next winding segment through a via which is within the boundaries of said generally spiral path and the vias unconnected at any particular winding segment passing through that winding segment without electrical contact; and at least one interstitial shield layer;

a shield on the shield layer including a serpentine conductor made of a series of courses, each pair of courses in said serpentine conductor propagating current in opposite directions for offsetting the induced magnetic fields and resulting currents.

8. The planar magnetic structure of claim 7 in which said spiral path is curvilinear.

9. The planar magnetic structure of claim 7 in which said spiral path is rectilinear.

10. The planar magnetic structure of claim 7 in which all of said winding segments are wound in the same direction.

11. The planar magnetic structure of claim 7 in which all of said winding segments are wound in the same direction alternately inwardly and outwardly.

12. The planar magnetic structure of claim 7 in which all of said winding segments are wound in the same direction.

13. The planar magnetic structure of claim 7 in which said winding segments are connected in series.

14. The planar magnetic structure of claim 7 in which said vias are offset with respect to one another within the boundaries of said generally spiral path.

15. The planar magnetic structure of claim 14 in which said vias are offset longitudinally along the direction of said generally spiral path.

16. The planar magnetic structure of claim 14 in which said vias are offset laterally in said generally spiral path.

17. The planar magnetic structure of claim 7 in which said winding segments have a whole number of turns.

18. The planar magnetic structure of claim 7 in which said windings segments have a fractional number of turns.

19. The planar magnetic structure of claim 7 in which said serpentine conductor is arranged in a circumferential path of less than one turn.

20. The planar magnetic structure of claim 7 in which said courses extend radially.

21. An electrostatic shield for a multilayer electronic device comprising:

a first set of conductors including at least two spaced courses;

a second set of conductors including at least two spaced courses interdigitated with said first set of conductors; each of said conductors includes a barrier section which separates the courses of the other set of conductors and is connected to a fixed potential.

22. The electrostatic shield of claim 21 in which said courses are curvilinear.

23. The electrostatic shield of claim 21 in which said courses are rectilinear.

24. The electrostatic shield of claim 21 in which said courses are less than one turn.

25. The electrostatic shield of claim 21 in which said device includes a magnetic structure having a core and said courses surround said core.

* * * * *